US005861903A

United States Patent [19]

Crawford et al.

[11] Patent Number: 5,861,903

[45] Date of Patent: Jan. 19, 1999

[54] INK FEED SYSTEM

[75] Inventors: Clark W. Crawford, Wilsonville; Brent R. Jones, Tualatin; Arthur C. VanHorne, Lake Oswego, all of Oreg.

[73] Assignee: Tektronix, Inc., Wilsonville, Oreg.

[21] Appl. No.: 612,149

[22] Filed: Mar. 7, 1996

[51] Int. Cl.[6] ..... B41J 2/175

[52] U.S. Cl. ..... 347/88; 347/99

[58] Field of Search ..... 347/84, 85, 88, 347/99

[56] References Cited

U.S. PATENT DOCUMENTS

| | | | |
|---|---|---|---|
| 4,462,035 | 7/1984 | Koto | 347/199 |
| 4,593,292 | 6/1986 | Lewis | 347/88 |
| 4,609,924 | 9/1986 | De Young | 346/1.1 |
| 4,682,185 | 7/1987 | Martner | 346/140 |
| 4,682,187 | 7/1987 | Martner | 346/140 |
| 4,870,430 | 9/1989 | Daggett et al. | 346/140 |
| 5,030,292 | 7/1991 | Miyazawa et al. | 647/88 |
| 5,442,387 | 8/1995 | Loofbourow et al. | 347/88 |

*Primary Examiner*—Peter S. Wong
*Assistant Examiner*—Y. J. Han
*Attorney, Agent, or Firm*—Ralph D'Alessandro

[57] ABSTRACT

An improved ink stick supply assembly is provided for a solid ink color printer which reliability feeds solid ink sticks from an ink stick loading bin to ink stick melt plates which melt the ink sticks on demand and guide the molten ink into individual color ink reservoirs in the printer print head. Low ink and empty ink level sensors are provided which advise the printer operator when to replenish the ink stick supply. A low friction material and spring loaded pusher blocks facilitate travel of the inks through the ink stick feed chutes to the melt plates.

17 Claims, 10 Drawing Sheets

INK FEED SYSTEM

FIELD OF THE INVENTION

This invention relates generally to feeding ink sticks to a printer and, more specifically, to a color ink stick supply system for a phase change or solid ink color printer that prevents jamming of ink sticks within the ink stick loading bin individual feed chutes and which senses low feed supply and empty feed supply ink stick supply levels within the individual ink stick feed chutes.

BACKGROUND OF THE INVENTION

Solid ink jet printers were first offered commercially in the mid-1980's. One of the first such printers was offered by Howtek Inc. and used pellets of colored cyan, yellow, magenta and black ink that were fed into shape coded openings that fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate rounded, five, six, and seven sided shapes each corresponding to a particular color.

Later more successful solid ink printers, such as the Tektronix Phaser™ III, the Tektronix Phaser™ 300, and the Jolt printer offered by Dataproducts Corporation, used differently shaped solid ink sticks that were either gravity fed or spring loaded into a feed chute and pressed against a heater plate to melt the solid ink into its liquid form. These ink sticks were shape coded and of a generally small size. One system utilized an ink stick loading system that initially feeds the ink sticks into a preload chamber and then loads the sticks into a load chamber by the action of a transfer lever. These ink stick feed systems melted the entire supply of ink, requiring all of the molten ink to be kept at an elevated temperature for extended periods of time to maintain the molten state, thereby tending to cause the molten ink to degrade over time from being maintained at the elevated temperature. Earlier solid or hot melt ink systems also used a flexible web of hot melt ink that is incrementally unwound and advanced to a heater location or employed vibratory delivery of particulate hot melt ink to the melt chamber.

As phase change ink color printers have increased their printing speed the need has developed to provide larger sized ink sticks so that refill of the ink reservoir in the print head is less frequent and more output or prints can be produced between refills. In designs where there is not a steep or generally vertical feed path to the heater plate, some provisions have been made to prevent the solid masses of shaped ink from sticking to the sides of the feed chutes so that an unrestricted feed of ink sticks proceed down into the heater plate for melting and filling of the individual colored ink reservoirs that are usually located within the print head. These larger sized ink sticks are fed into receptacles or openings in a cover plate over the feed chutes. If an ink stick is inadvertently inserted within the wrong receptacle it can be difficult for the printer operator to remove the ink stick, especially because of the sticky nature of the ink sticks' waxy exterior surfaces that can cause them to become wedged in the incorrect ink stick receptacle. There is a need to provide an effective and efficient way to feed a plurality of ink sticks in an ink stick feed bin to melt plates for melting to feed molten ink into the individual colored ink reservoirs. There is also a need to feed only the amount of molten ink that is needed for printing, or to melt the solid ink on demand.

These problems are solved in the design of the present invention by providing an improved solid ink stick loading system and that guides a plurality of solid ink sticks down a plurality of individual ink stick feed chutes to heated melt plates which melt the lead solid ink sticks in each ink chute and deliver the melted ink to individual colored ink reservoirs where the ink is maintained in a heated state until jetted by the print head.

SUMMARY OF THE INVENTION

It is an aspect of the present invention to provide an improved ink stick feed system for a solid ink printer that prevents or substantially reduces jamming of the ink sticks in the individual feed chutes.

It is another aspect of the present invention to provide an improved ink stick feed system that provides ink sticks to the heated melting plates on demand to melt ink as it is needed for printing.

It is still another aspect of the present invention to provide an improved ink stick feed system which senses a low ink supply state and an empty ink supply state in the individual ink stick feed chutes to assist the printer operator in knowing when to replenish the ink stick supply.

It is a feature of the present invention that the individual ink stick feed chutes within the ink stick feed bin guide the individual solid ink sticks to the heated melt plates for melting and delivery of the molten ink into the heated individually colored liquid ink reservoirs.

It is another feature of the present invention that ink sticks are pushed towards the individual melt plates by use of constant force springs acting on a block within each ink feed chute.

It is still another feature of the present invention that the constant force springs used to advance the ink sticks in the individual ink feed chutes retract when the feed cover is raised to permit ink sticks to be loaded into the individual ink feed chutes in the ink stick feed bin.

It is another feature of the present invention that the individual ink stick feed chutes within the ink stick feed bin have sensing means to sense when the individual supply of ink sticks within each ink stick feed chute becomes low and again when the supply is depleted, providing feedback to the operator to reload the ink stick supply.

It is still another feature of the present invention that the improved ink stick feed supply system includes a material on the bottom of the individual ink stick feed channels that promotes easy passage of the ink sticks along the bottom of the ink stick feed chutes and into contact with the heated melt plates.

It is an advantage of the present invention that the improved ink stick feed system provides an efficient and simple way of providing ink sticks to the heated melt plates to insure a continuous supply of molten ink for printing.

It is another advantage of the present invention that replenishing the solid ink supply in the printer is simple and easily accomplished by the printer operator.

It is a further advantage of the present invention that the loading of the ink sticks and the feeding of the ink into the individual color reservoirs is not obstructed or hampered by flakes or particles of ink from the individual ink sticks.

It is still another advantage of the present invention that the status of the ink stick supply within the individual ink stick feed chutes is visible to the operator from feedback provided by the "ink low" and "ink empty" status sensors.

These and other aspects, features and advantages are obtained by the solid ink stick feed system of the present invention that provides easy, trouble-free feed of a plurality of solid ink sticks of each color upon demand to the heated melt plates within the print head of the color ink printer.

BRIEF DESCRIPTION OF THE DRAWINGS

These and other aspects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

The improved ink feed assembly of the present invention is designed to automatically feed wax based ink, molded in generally a block form, into integral melt plates 29A–D for replenishment of the melted ink volume in the reservoirs used in the solid ink color printer 10.

Figure 1:
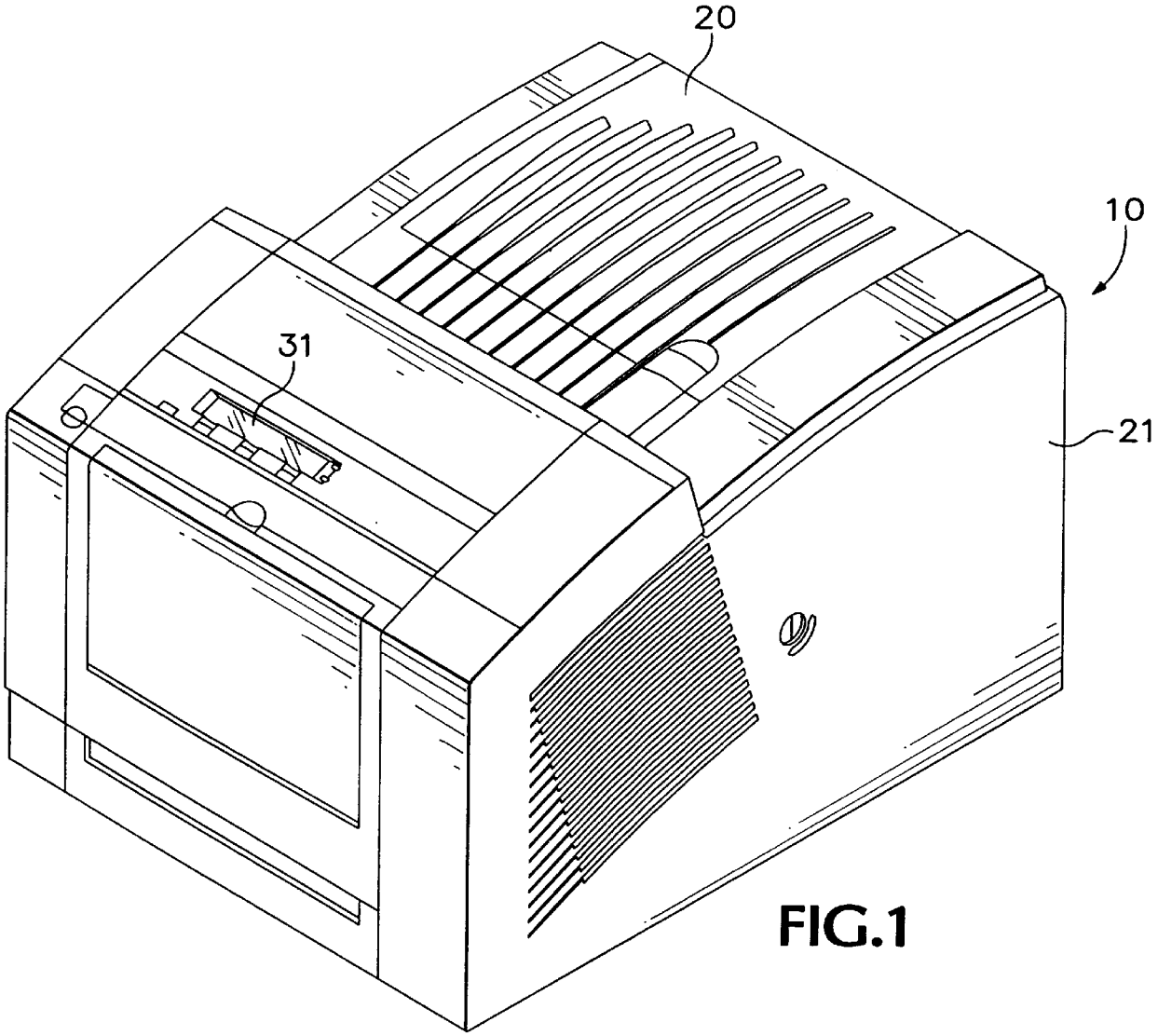
FIG. 1 is a perspective view of a color printer with the printer top cover closed.

FIG. 1 discloses a portion of a solid ink stick printer, indicated generally by the numeral 10, with the printer top cover 20 raised so that the attached ink stick feed cover 30 is also raised, disclosing the ink stick feed or loading bin with the key plate 18 positioned within the printer sidewalls 21. The feed cover 30 is pivotally mounted to the yoke 17 that is connected to the ink stick loading bin assembly 16 adjacent the printer side frames 21 by pivot arms 22 of FIGS. 1–3 and pivot pins 23 (see FIG. 4 briefly). An ink stick feed front cover plate or yoke 17 is mounted to the ink stick loading bin atop of the key plate 18 for sliding movement along the top of the key plate 18 to assist in moving the individual ink sticks 12A–D, indicated generally in FIG. 1 by the numeral 12, forward in the feed chutes 25A–D toward the melt plates 29A–D of FIG. 4.

Ink sticks 12A–D are inserted into the appropriately shaped receptacles or openings 24A–D in the key plate 18 of the ink stick loading bin assembly 16 to feed the solid ink sticks down the corresponding ink stick feed chutes 25A–D to the melt plates 29A–D which melt the ink and feed it into the individual ink color reservoirs within the print head (not shown) of the printer 10. The ink sticks 12A–D consist of the four primary colors of cyan, yellow, magenta and black, each having its own distinctive shape with a correspondingly shaped opening or receptacle 24A–D being provided in the key plate 18 to help ensure that the correct colored ink stick 12A–D is loaded into the appropriate and corresponding ink stick feed chute 25A–D to prevent color contamination of the inks in the individual color reservoirs (not shown) in the print head (also not shown), both of which are described in detail in co-pending U.S. patent application Ser. No. 08/610,564, filed on Mar. 6, 1996 entitled "High Performance Ink Jet Print Head Having An Improved Ink Feed System".

Figure 2:
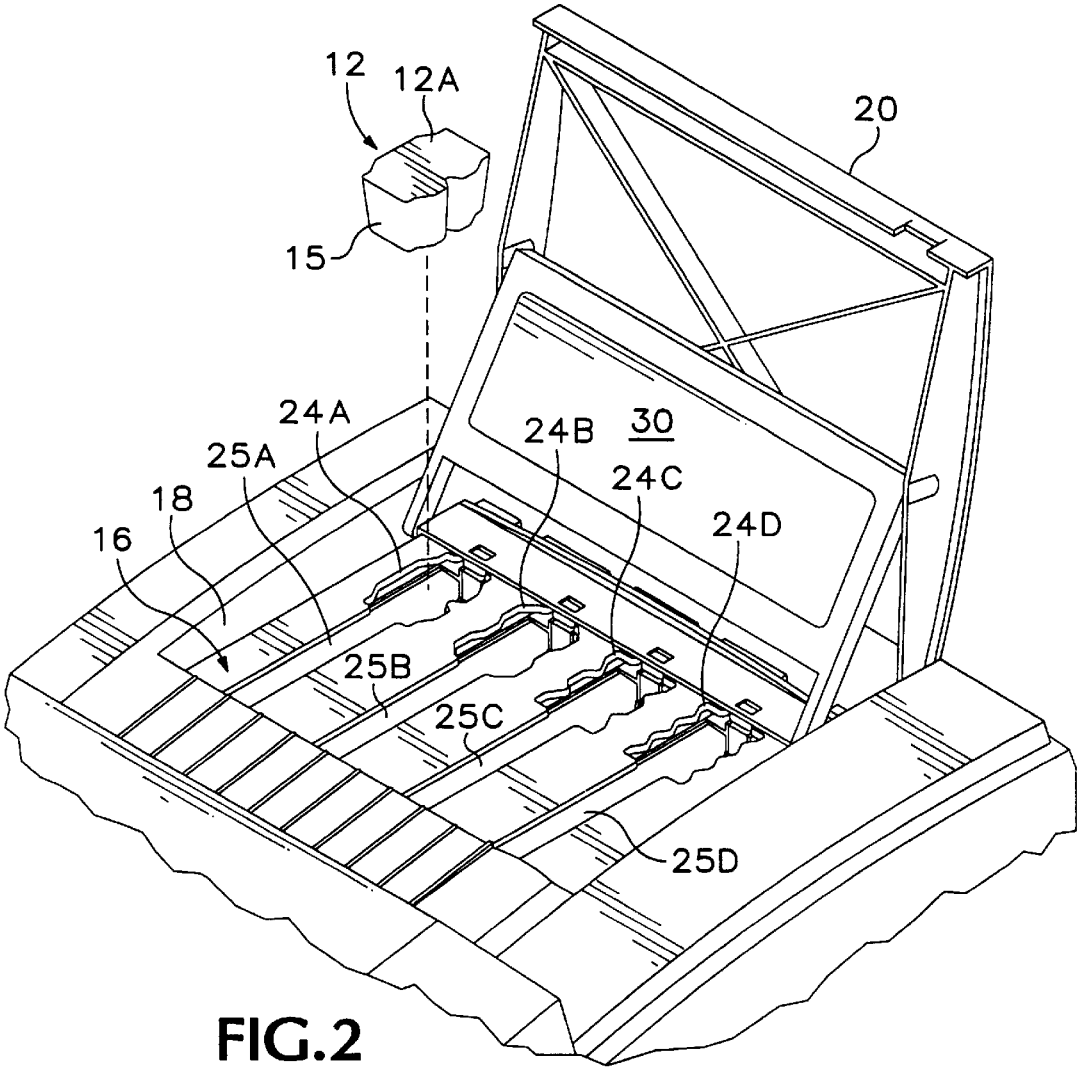
FIG. 2 is an enlarged partial top perspective view of the color printer with the solid ink stick feed bin cover and printer cover open showing a solid ink stick in position to be loaded into the appropriate ink stick receptacle.

The ink sticks 12A–D are generally tapered from their top downwardly and inwardly to their bottom. The top and bottom of each stick 12 is connected by the tapered sides 11 and may have an upper flared portion. The opposing end portions 15, only one of which is best shown in FIG. 2, have a semi-protruding nose portion 14 in the center of each end to prevent or minimize jamming due to wedging along the sides of the appropriate individual ink stick feed chute 25A–D.

Each chute 25A–D preferably can have a pair of shoulders and a bottom channel into which the properly inserted ink stick 12 should extend to permit it to be fed the length of the appropriate chute 25A–D to the melt plate 29. A friction reducing material 28, such as a felt or polyester fiber, may be employed to facilitate sliding of the ink sticks down the appropriate chute 25A–D.

Figure 3:
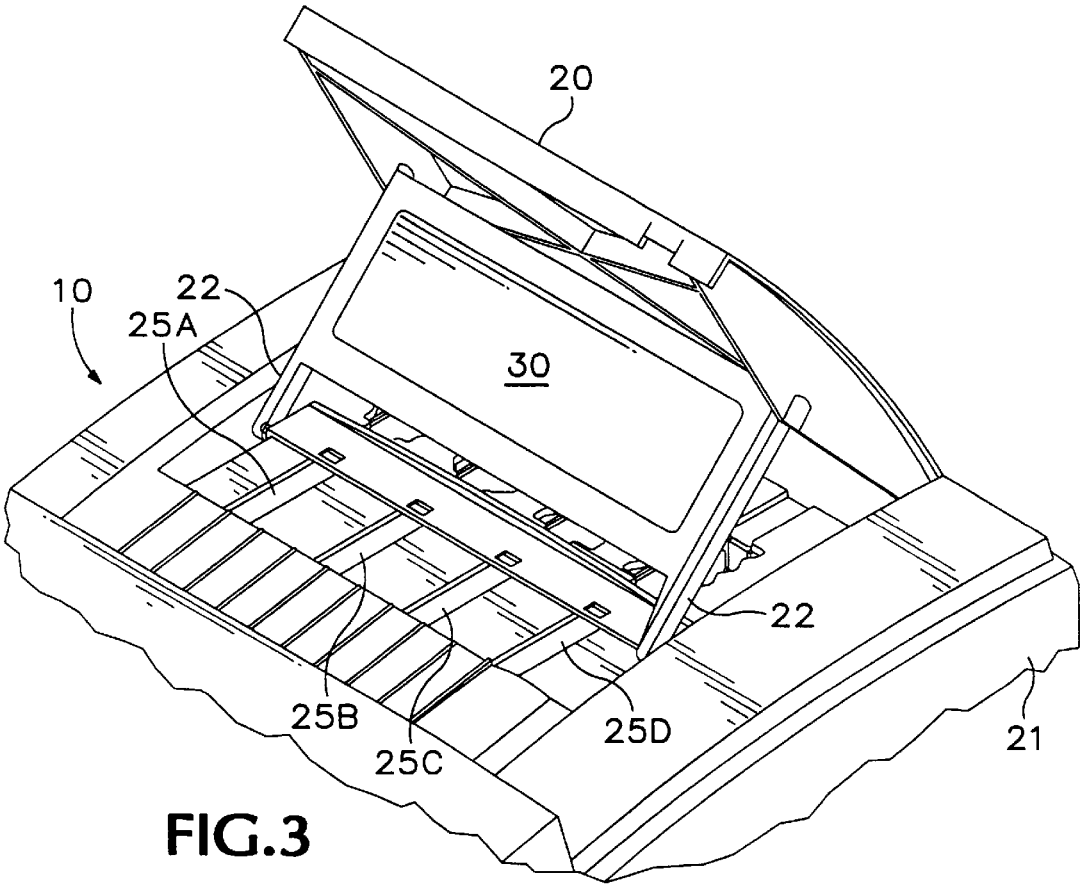
FIG. 3 is an enlarged partial top perspective view of the color printer with the solid ink stick feed bin cover and printer top cover partially closed showing movement of the bail and yoke assembly advancing the push blocks against any ink sticks within the ink stick feed bin chutes.
Figure 4:
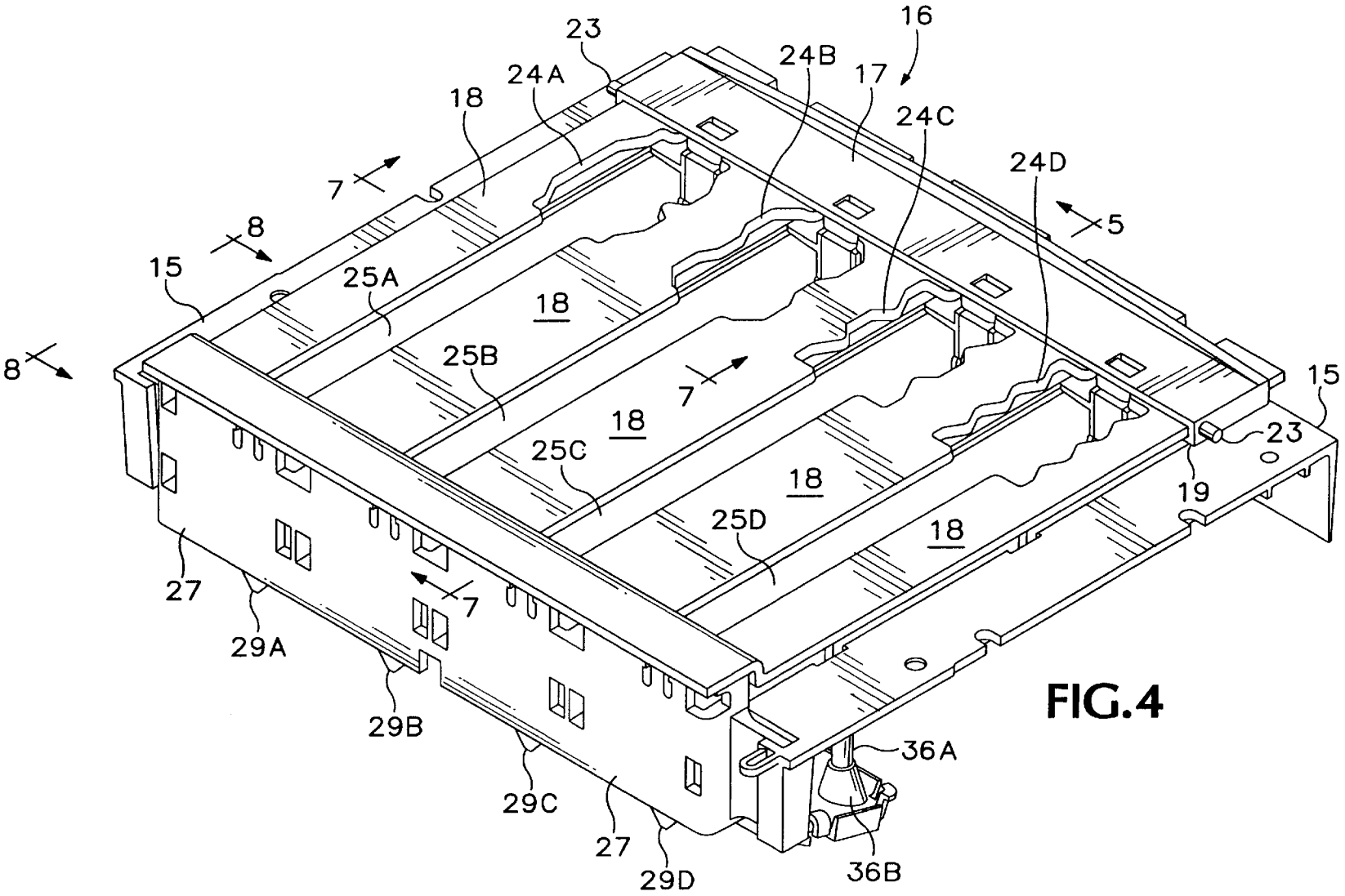
FIG. 4 is a top perspective view of the key plate assembly and the melt plate assembly that are part of the ink stick feed bin.

The ink stick loading bin 16 holds four ink colors, each color stick 12A–D is similar in volume and has a distinctive shape. The main body of the loading bin assembly 16 has four ink stick feed chutes 25A–D, as seen in FIGS. 2–4, accommodating four rows of three plus ink sticks 12A–D, nested horizontally, end to end. The walls of the individual feed chutes 25A–D have a specific transition angle, allowing only minimal contact with the ink sticks 12A–D while guiding them to the melt plates 29A–D. Every color is assigned a specific chute 25A–D. The colors have a unique shape in the top-bottom cross section and will only fit through the matching keyed opening or receptacle 24A–D in the ink stick feed bin assembly top plate or key plate 18. Keying makes accidental mixing of the ink stick colors improbable.

Preloading of each individual chute 25A–D with ink is facilitated by use of constant force springs 54 acting on push blocks 50A–D which push the individual ink sticks 12A–D toward the melt plates 29A–D, as seen in FIGS. 5–9. The springs 54 are wound on freely rotating drums 55 housed in the push blocks, best seen in FIG. 11. Loading and feeding of the ink sticks 12 can cause flakes and particles of ink to be drawn by gravity to the bottom of the ink stick feed chutes 25A–D. The springs 54 are positioned at the top of the chutes 25A–D to help keep the chutes free of ink debris. Placement of the springs 54 at the top necessitates retracting the springs 54 when loading ink sticks 12 into the ink stick loading bin assembly 16.

The ink stick loading bin assembly 16 is covered by key plate 18 and printer top cover 20, the latter which acts to protect the ink sticks 12, contributes to the printer aesthetics, helps support the paper output tray and simplifies ink stick 12 insertion. A bail and yoke configuration couples the four independent push blocks 50A–D through the constant force springs 54 of FIG. 11 to the ink stick feed cover 30. The anchored end of the springs 54 are attached to yoke 17 which is connected to the cover 30 through a pair of pivoting bails or arms 22 mounted about pivot pins 23. The ends of the yoke 17 are held by the key plate 18 in a track 19 such as to provide a linear slide along the opposing sides of key plate 18.

Figure 11:
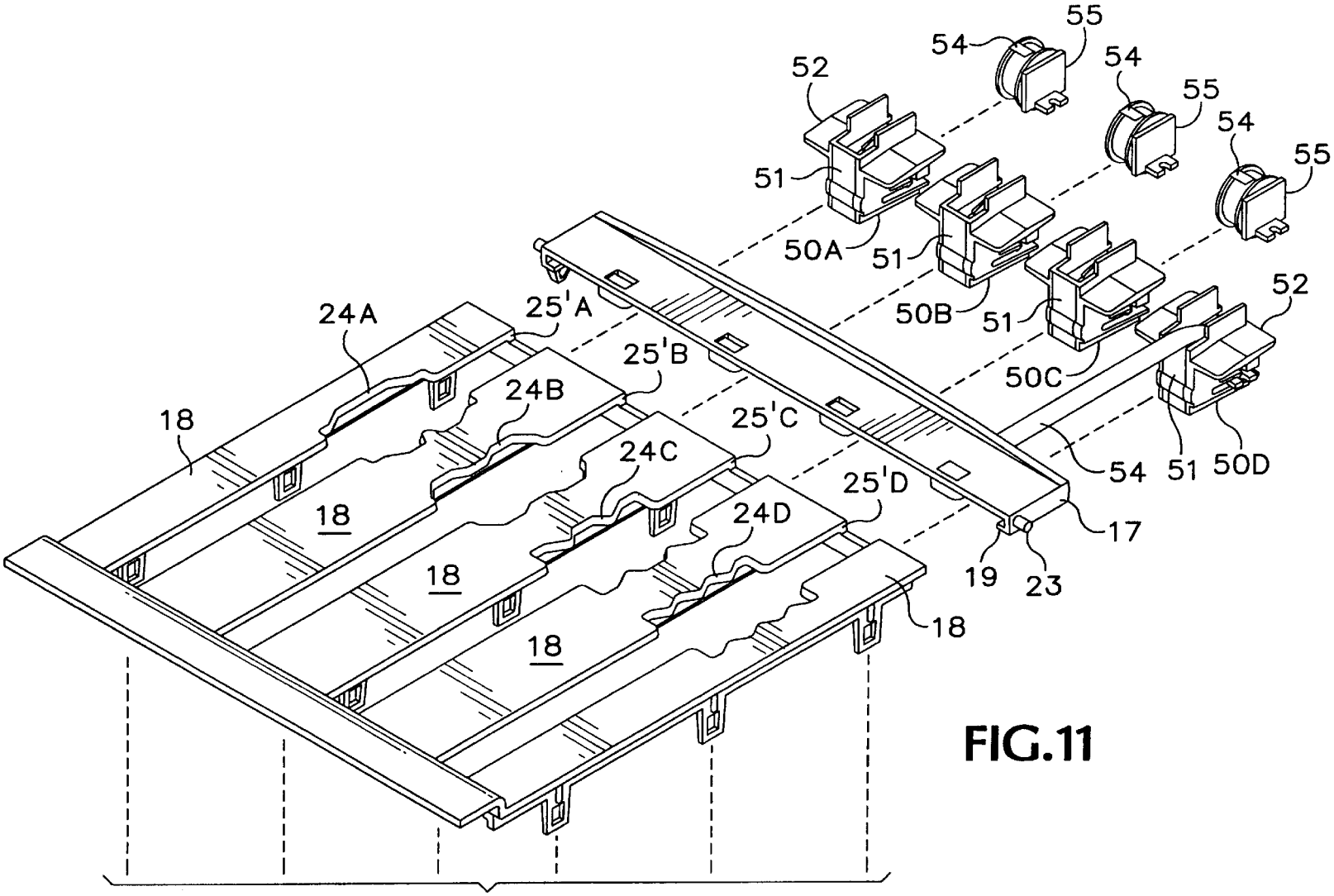
FIG. 11 is an exploded view of the key plate assembly of FIG. 4 showing the bail and yoke assembly and the over-center spring arrangement that advances the ink stick pusher blocks into contact with the individual ink sticks.

Lifting the printer top cover 20 and, therefore, the articulated ink stick feed cover 30 forces the ink push blocks 50, best seen in FIG. 11, back to a clear position shown in FIG. 2, allowing ink sticks 12A–D to be inserted through the keyed openings or receptacles 24A–D in front of the blocks 50. When open, full length slots 25'A–D in the key plate 18 make it easy to assess the remaining ink supply for all ink stick 12 colors. Closing the printer cover 20 causes the push blocks 50 to apply a force through the flat front surfaces 51 against the ink sticks 12A–D that is directed toward the melt plates 29A–D, best seen in FIG. 6. The bail and cover design is configured to act as the cover latch by traveling over-center against the spring force in the down position. This design simplifies and speeds ink stick 12 replenishment by automatically providing access to the ink stick receptacles 25A–D, applying the necessary spring force against the ink sticks 12A–D and allowing ink sticks 12 of any color to be added regardless of the remaining supply of the other colors.

Springs 54, which force the push blocks 50A–D forward, also act on the covers 20 and 30. When opening the printer top cover 20, the cover 20 tends to be yanked up very suddenly as it passes through the over-center position. Friction has been intentionally added to certain parts to achieve some control over the motion of the cover 20. Constant force springs 54 impart a rotational moment in the yoke 17 which provides friction between the yoke 17 and key plate 18. Additional beneficial friction is supplied by the push blocks 50. Blocks 50A–D are held in their ink stick feed chutes 25A–D via flexible preloading tabs 52, best seen in FIGS. 5, 6 and 11, sandwiched between the ink stick feed chutes 25A–D and the key plate 18. Friction at all of these points is relied upon to impart a smooth controlled feeling to the motion of the printer cover 20 and helps to keep the cover 20 from opening too quickly. An end of travel spring is built into each slot of the key plate 18 to absorb any remaining "door opening" force. Removal of the ink stick cover 30 from the ink stick loading bin 16 is facilitated by these same springs. They allow the cover 30 to be pivoted beyond its normal open stop point so the bails can be aligned with a relief on the part that guides them, allowing disassembly.

Solid or phase change ink strongly adheres to surfaces with which it comes into contact. Normal operating temperatures of the color printer 10 for the solid ink ranges from about 40° C. to about 50° C. In this temperature range, phase change ink tends to adhere so tenaciously to most materials that an impractical amount of force is required to move it reliably. Because the ink is a wax like substance, cracking, surface flaking and "shaving" of ink sticks during handing and loading can occur. Sticky debris in the ink slots can cause the ink sticks 12 to become stuck, interfering with feeding ink sticks to the melt plates 29A–D. A friction reducing material 28, such as a felt or polyester fiber, may be employed to facilitate sliding of the ink sticks 12 down the appropriate chute 25A–D.

Figure 5:
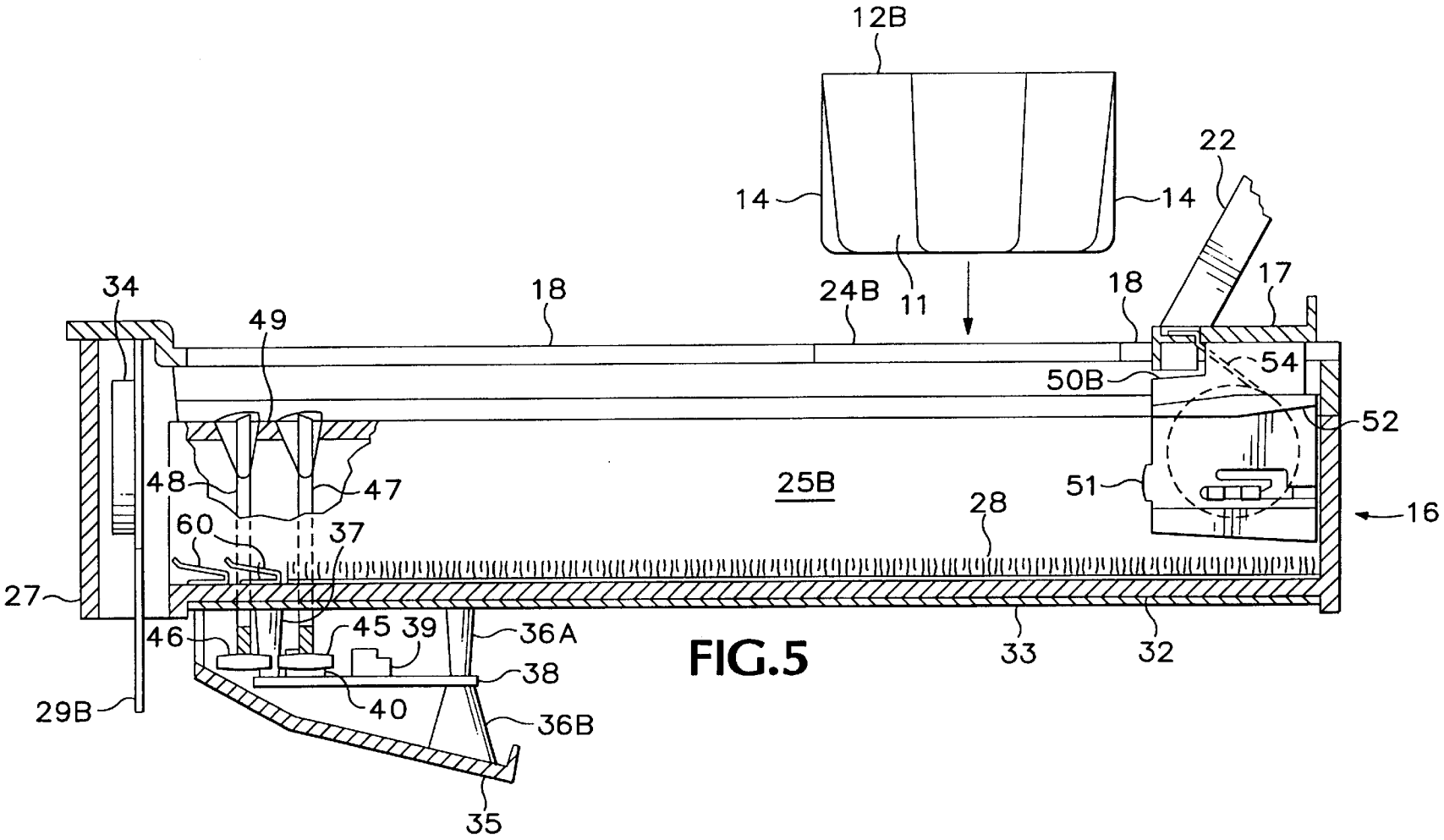
FIG. 5 is a side sectional view taken along the lines 5—5 of FIG. 4 showing an ink stick feed chute and the ink stick supply sensing assembly.
Figure 6:
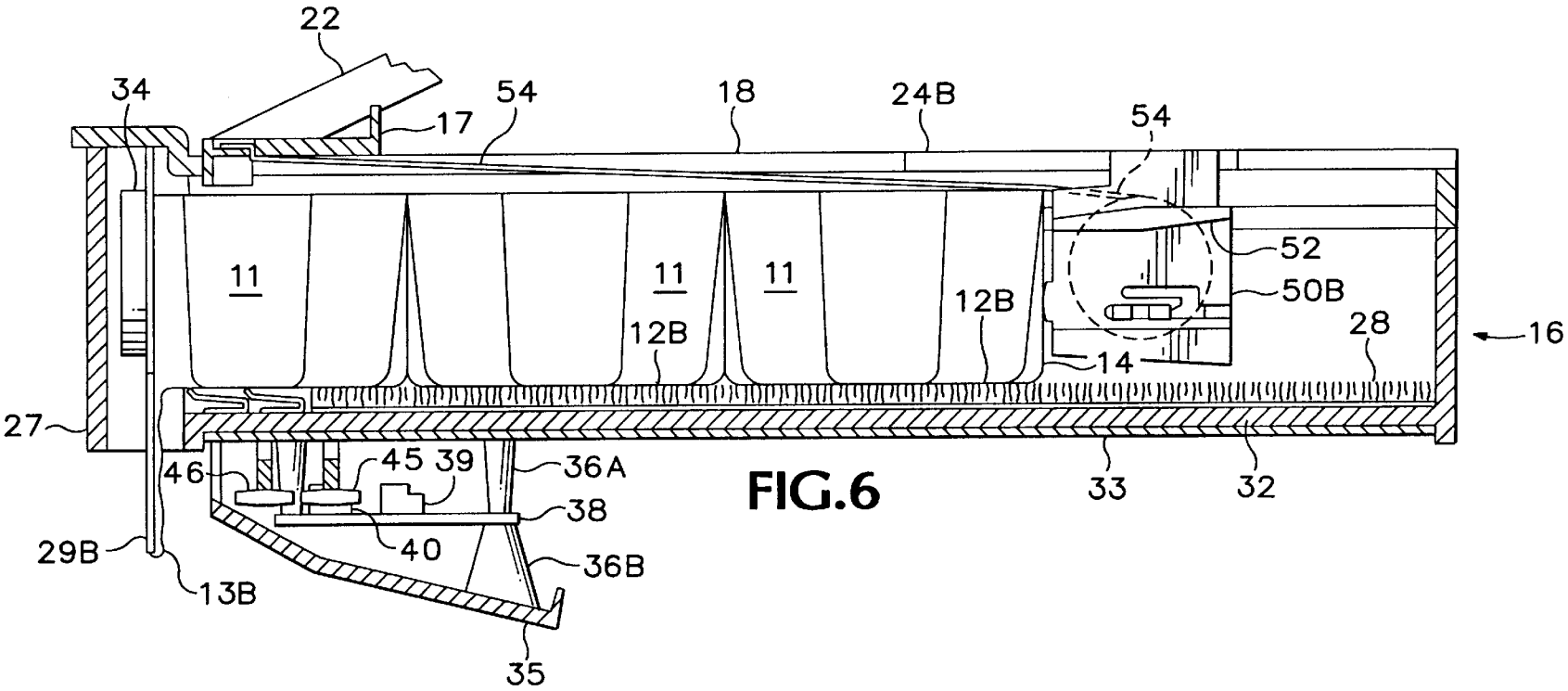
FIG. 6 is a side sectional view taken along the lines 5—5 of FIG. 4 showing an ink stick feed chute with ink sticks loaded in the ink stick feed bin cover closed and the push block advancing the ink sticks toward the melt plate.
Figure 7:
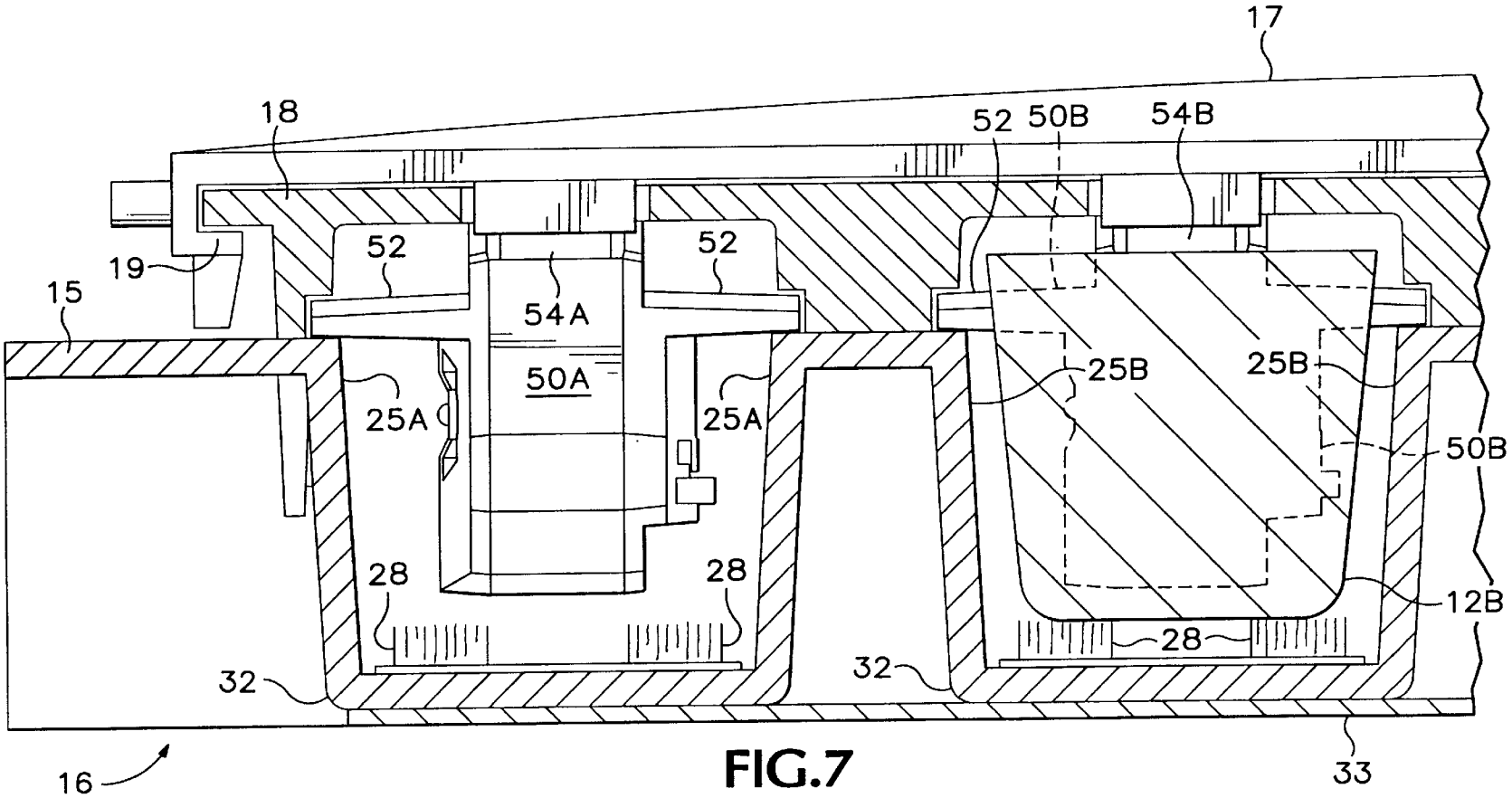
FIG. 7 is a partial sectional end elevational view of the ink stick feed bin ink chutes taken along the section lines 7—7 of FIG. 4.
Figure 8:
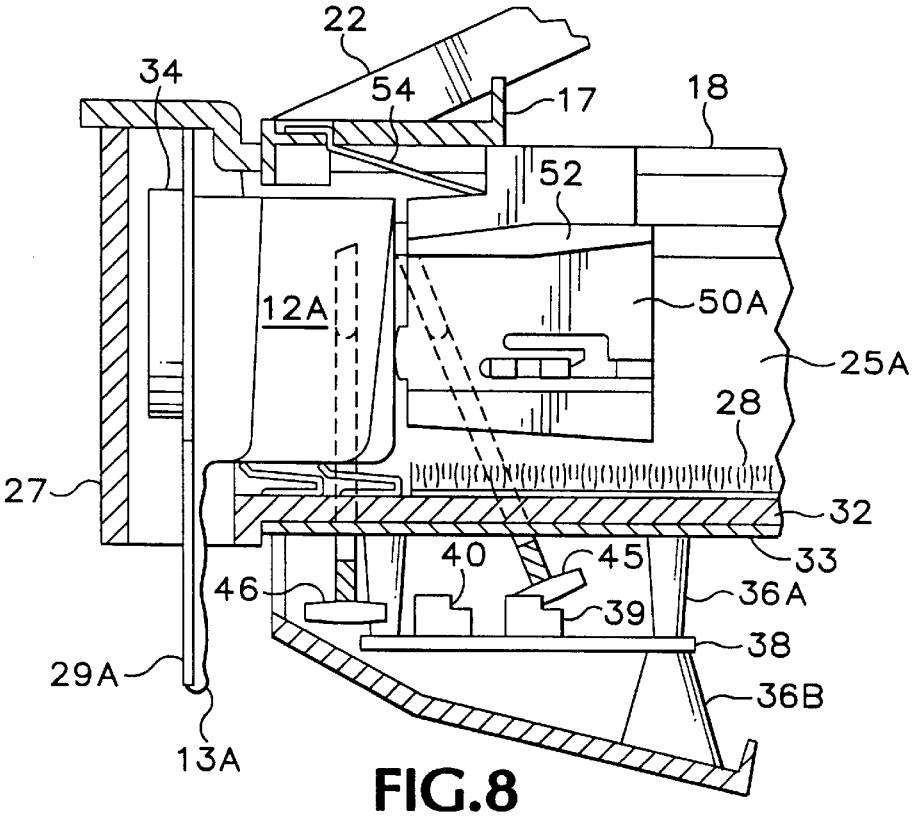
FIG. 8 is a partial sectional side elevational view of an ink stick feed chute and the ink stick supply sensing mechanism taken along the section lines 8—8 of FIG. 4 showing a "low ink" supply sensing position.
Figure 9:
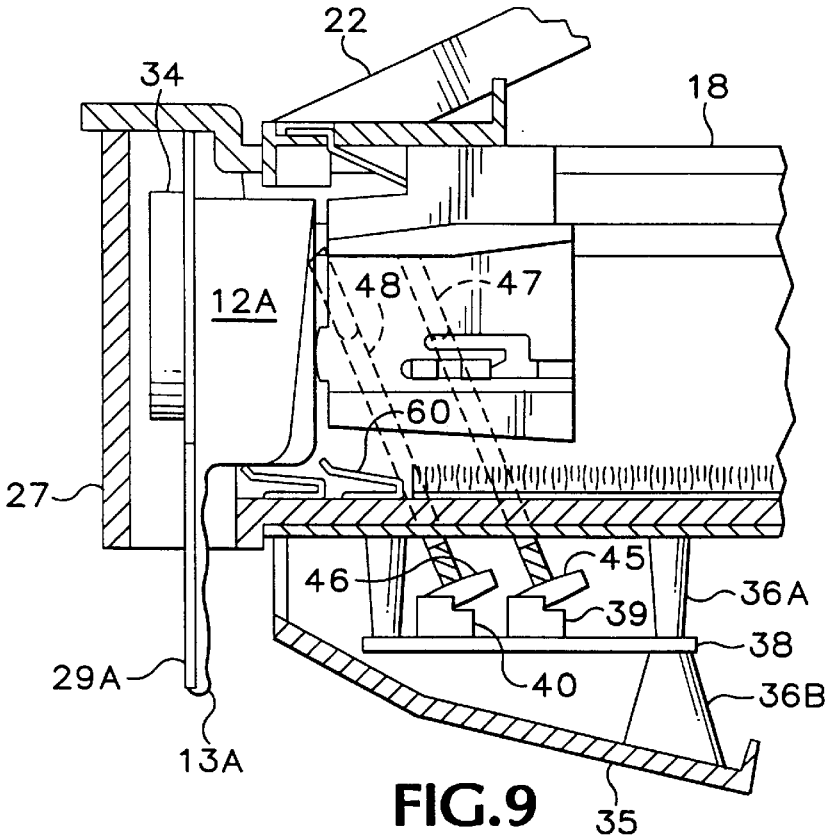
FIG. 9 is a partial sectional side elevational view of an ink stick feed chute and the ink stick supply sensing mechanism taken along the section lines 8—8 of FIG. 4 showing a "empty ink" supply sensing position.

The material 28, best seen in FIG. 5 and 6, keeps the friction between ink sticks 10 and chute 25, bottom 32 low. Ink sticks 12 are supported on the tips of fibers so there is very little surface area contact. Further, the fibers easily bend, so a peeling motion at the tips makes it easy to break any bonding which occurs between the ink sticks and the fiber. Material 28 is configured with fibers packed in a manner similar to carpet or velvet, but formed into long, narrow, shallow depth strips with fiber ends extending up from a fabric backing. Two strips of the material 28 are shown protruding above the bottom 32 of the chutes 25A–D, as seen in FIG. 7. These strips support the ink sticks 12 over the area of the ink sticks 12 just inside the narrowed outer perimeter of the bottom of the ink sticks 12. A preferred approach is to use a single strip of the material 28. Small amounts of ink debris thus can easily be carried along with the ink sticks 12 and not cause the ink sticks 12 to become stuck. The fibers of the material 28 can also be oriented at an angle to reduce the ink stick feed force, while increasing the force required to pull the ink back toward the receptacles 24A–D. Alternatively the chutes 25A–D can have a recessed channel (not shown) in the bottom 32 to which the material 28 can be attached so that the ink sticks 12 seat correctly within the channel, but are held in a raised position on chute support if improperly oriented upon feeding. Spring loaded ink locks 60, seen in FIGS. 5 and 6, can be positioned near the front of the ink stick feed chutes 25A–D to hold the leading ink sticks 12A–D to prevent their traveling backwards with the push blocks 50A–D upon opening of the cover 20 should the ink sticks adhere to the front of the push blocks. Alternate means to accomplish this same result can be employed, such as attaching a non-adhering material to the front of the blocks 50A–D or using a roller conveyor system to transport the ink sticks 12 without sticking. The preferred method is the use of silicon foam, available from Boyd Rubber Corporation of Portland, Oreg., on the push block flat front surface 51 to provide even contact with the ink sticks 12 and distribute the force evenly to insure the ink sticks 12 are correctly oriented within the ink stick feed chutes 25A–D and to prevent sticking to the surfaces 51.

As illustrated in FIGS. 5–6 and 8–9 a "low ink" supply status and an "empty ink" supply status sensing are obtained by use of optical interrupter sensors 39 and 40, available commercially from Omron Electronics, Inc. of Schaumburg, Ill. as Model J45 photointerrupter sensors. These sensors have an LED and a phototransistor with apertures over opposing optical devices to sense when any opaque material interrupts the signal between the LED and the phototransistor. The sensors 39 and 40 are actuated by opaque tipped mechanical flags 45 and 46, respectively. The flags 45 and are moved by contact with the leading push block tabs 52 of the feed chute 25A–D with the least amount of ink. As other colors of ink are used after one color reaches the "low" point, their push blocks will come into contact with the low ink flag but will not further alter the "ink low" supply status signal displayed on the front panel message window 31 of FIG. 1 of the printer 10. The "ink empty" message appears when any one of the feed chutes 25A–D ink stick supply reaches that low point. Tabs 52, while shown as tapered, are preferably of a uniform thickness to enhance the reliability of the flag contact.

Figure 10:
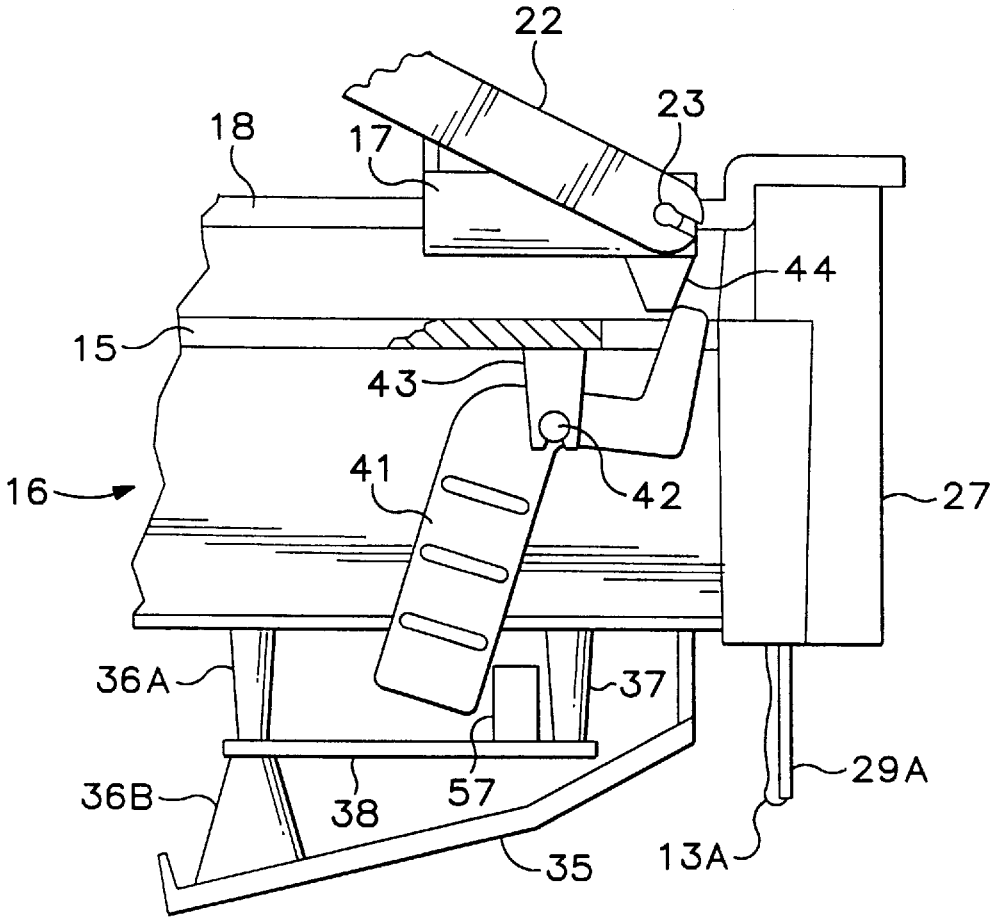
FIG. 10 is a partial side elevational view of the ink stick feed bin showing the flag used as an interrupter for the sensor for sensing the printer top cover open status.

FIG. 10 shows the printer front cover open sensor 57 that is activated by the yoke hammer 44 contacting the flag 41 when the printer front cover 20 is open. This causes the opaque flag 41 to break the signal between the LED and the phototransistor in the Omron Electronics, Inc. Model 1079 photointerrupter sensor 57. The flag 41 pivots about sensor flag pivot pin 42, which is retained in bracket 43 that is fastened to the bottom of ink stick loading bin flange 15. When the cover 20, and the attached ink stick feed bin cover 30 (see briefly FIGS. 2 and 3) is closed, the yoke 17 is pulled to the opposite end of the key plate 18 and the path between the optical devices on the LED and the phototransistor of the sensor 57 is unblocked. The front cover open sensing is displayed on the message panel 31 of the printer 10.

Melt plates 29A–D are made of alumina and use thick film resistor material for heaters. A positive temperature coefficient resistor (PTC device) 34, commercially available from the Siemens Component Division of Siemens Corporation in Portland, Oreg. as part A59810-8160-A10, in series with the thick film resistor, is used to limit the current so that the heater cannot rise above an acceptable free air temperature. The PTC device 34 is preferably about a 25 millimeter round disk that is about 2.6 millimeters thick utilizing a chromium nickel gold electrode to achieve a sharp increase in resistance and therefore temperature at the desired temperature.

A melt plate adapter assembly 27, which positions and retains the melt plates 29A–D offset a desired distance from the stick feed chutes 25A–D, mounts to the ink stick loading bin 16 and functions as a safety barrier against high temperature and voltage by enclosing the top, front and sides of the melt plate area. The bottom of the melt plates 29A–D, which protrude below the melt plate adapter assembly 27 (see FIG. 4 briefly) are angled at controlled drip location for the melted ink 13 (see FIGS. 6, 8 and 9) to direct the molten ink downwardly into the appropriate reservoir. The offsetting of the melt plates 29A–D permits the molten ink to run down the inner surface of the melt plates 29A–D and not back up into the individual ink stick feed chutes 25A–D. An appropriately materialed deflector plate 33, such as aluminum, is affixed to the bottom of the ink stick loading bin 16, as seen in FIGS. 5–9, to help dissipate any heat that may build up from the melt plates 29A–D in the ink stick loading bin 16. A similar heat deflector shield 35 is provided for the same purpose to protect the circuit board 38 for the ink supply status sensors 39 and 40.

Flow of the molten ink 13 is determined primarily by the temperature of the heated melt plate 29 surface. In order to control the speed and direction of the molten ink flow front, a specifically configured Kapton insulator film is positioned on the ink stick side of the resistance heater. The insulator enables the melt plate area surrounding the ink sticks 12 to become hotter than the area in contact with the ink. Because the temperature of melted ink 13 rises as it spreads onto the melt plate 29, it thins enough to efficiently run down under force of gravity and drip off of the tip of the plates 29, as opposed to spreading in an undesired fashion. The insulator material allows the melted ink 13 on the melt plates 29 to reach a desirable temperature before dripping off of the individual plates without having to raise the whole melt plate 29 to an undesirably high temperature. The temperature difference between the insulator material and the individual melt plates 29 provides the benefit so that as the ink stick 12 front stops melting when the heaters are turned off, the melted ink 13 remaining on the top, sides and bottom of the plate 29 continues flowing off of the plate, leaving the individual plates free of all but a very thin film of ink. This is significant since a thicker film could drop off as unmelted "sheets" the next time the heater begins to come up to melt temperature.

In use, the operator initially loads or reloads the ink stick loading bin 16 of the color printer 10 with ink sticks 12 by raising the printer cover 20 and the ink stick loading bin cover 30 and placing the appropriately colored and shaped ink sticks in the corresponding appropriately shaped ink stick receptacle 24A–D that permits the ink stick 12 to fall into the appropriate feed chute 25A–D. If the ink stick 12 is placed in the incorrect receptacle 24A–D, the tapered sides 11 interfere with the sides of the ink stick receptacle 24A–D and the ink stick is held in a raised position. The operator then grasps the exposed portion of the ink stick 12 and removes it from the incorrect receptacle prior to insertion in the correct receptacle in the key plate 18. If the correct ink stick 12 is improperly inserted in the correct receptacle 24A–D, the ink stick 10 is supported by the shoulders so that the exposed portion extending above the top of the key plate 18 is readily visible and is easily removed and reinserted with the proper orientation by the operator. Once all of the ink sticks 12 are properly inserted, the printer top cover 20 and the connected ink stick loading bin feed cover 30 are closed and the feed cover or yoke 17 with the individual chute pusher blocks 50A–D is spring l6aded against the ink sticks 12 to urge them down the chutes 25A–D until the front ink stick 12A–D in each chute 25A–D is pressed against the heated melt plates 29A–D and the ink is melted into the individual colored reservoirs within the print head.

While the invention has been described above with reference to specific embodiments thereof, it is apparent that many changes, modifications and variations in the materials, arrangements of parts and steps can be made without departing from the inventive concept disclosed herein. For example, in employing the improved solid ink stick feed system of the present invention, it should be noted that ink sticks of any shape could be employed as long as the ink stick key plate has the correspondingly shaped receptacle or opening therein to control the selective feeding of the ink sticks into the appropriate ink stick feed chute. Similarly, the invention can be used for color printers where a plurality of different colors are employed or for a gray scale printer where different shades of black are employed to ensure contamination of the colors in the individual ink reservoirs within the print head does not occur.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A solid ink stick feed system selectively permitting ink sticks of a predetermined shape to be fed into a printer and not permitting improperly shaped or improperly oriented ink sticks to be fed, the system comprising in combination:

a. an ink stick feed bin having areas for receipt of a plurality of ink sticks, the ink sticks having a plurality of distinctive shapes, the areas accepting ink sticks that are only oriented correctly;

b. an ink stick feed bin cover connectable to the ink stick feed bin and movable between a closed position and an open position;

c. a loading plate for the ink bin, the loading plate having a plurality of receptacles corresponding to the plurality of distinctive ink stick shapes and each receptacle matched to a predetermined ink stick shape;

d. guide means to guide the plurality of ink sticks through the areas of the ink stick feed bin, the guide means being positioned within each area for receipt of a plurality of ink sticks within the ink stick feed bin and movably mounted therein, the guide means being retractable as the ink stick feed bin cover moves between the closed position and the open position; and e. heater means adjacent the ink stick feed bin areas positioned to receive individual ink sticks guided thereto by the guide means to melt the ink sticks and guide the molten ink to collection means separated according to a distinctive color quality of the ink.

2. The solid ink stick feed system according to claim 1 further comprising the areas for receipt having a plurality of ink stick feed chutes corresponding in number to the plurality of distinctive ink stick shapes, each shape having a corresponding distinctive color quality.

3. The solid ink stick feed system according to claim 2 further comprising the plurality of ink stick feed chutes each having a bottom that is insulated to protect against the build-up of heat from the heater means.

4. The solid ink stick feed system according to claim 3 further comprising the heater means being a resistance heated melt plate.

5. The solid ink stick feed system according to claim 4 further comprising the heater means comprising a plurality of melt plates corresponding in number to the plurality of ink stick feed chutes.

6. The solid ink system according to claim 5 further comprising melt plates being angled at a controlled drip location to direct ink downwardly into the appropriate collection means.

7. The solid ink system according to claim 4 further comprising an insulator material attached to each melt plate to help melt the ink sticks that are guided into contact therewith on demand and control a temperature of the molten ink on each melt plate.

8. The solid ink stick feed system according to claim 1 further comprising the guide means to guide the plurality of ink sticks being push means.

9. The solid ink stick feed system according to claim 8 further comprising the guide means being spring loaded.

10. The solid ink stick feed system according to claim 8 further comprising the heater means further melting only the amount of molten ink needed for printing.

11. The solid ink system according to claim 1 further comprising a printer cover connected to the ink stick feed bin cover and movable between an open position and a closed position as the ink stick feed bin cover moves between its corresponding open position and closed position to permit replenishment of ink sticks in the printer.

12. A solid ink feed system selectively permitting solid ink pieces of a predetermined shape to be fed into a printer and not permitting improperly oriented solid ink pieces to be fed, the system comprising in combination:

a. an ink feed bin having areas for receipt of a plurality of solid ink pieces of a plurality of colors, the areas accepting solid ink pieces that are only oriented correctly;

b. a cover for the ink feed bin, the cover having a plurality of receptacles corresponding to the plurality of colors of the solid ink pieces and each receptacle matched to a predetermined solid ink color;

c. guide means cooperative with the plurality of receptacles and the ink feed bin areas for receipt of ink pieces to contact and guide the plurality of solid ink pieces through the areas of the ink stick feed bin; and d. a top cover connected to the ink feed bin in a movable fashion and connected to a bail and yoke movement system so as to move in articulated motion between an open position and a closed position, the top cover providing access to the ink feed bin receptacles in the open position and in the closed position being connected to the guide means cooperative with the plurality of receptacles to advance the guide means into contact with the plurality of solid ink pieces in the plurality of receptacles.

13. The solid ink feed system according to claim 12 further comprising the guide means to guide the plurality of ink sticks being push means.

14. The solid ink system according to claim 13 further comprising the push means to guide being spring loaded.

15. The solid ink system according to claim 14 further comprising the top cover traveling over-center against the spring loaded push means when moving from the open position to the closed position.

16. The solid ink system according to claim 14 further comprising the spring loaded push means being connected to the yoke via at least one spring.

17. The solid ink system according to claim 12 further comprising the guide means cooperative with the receptacles to contact and guide the pieces of solid ink having a non-adhering contact surface to prevent the pieces of solid ink from sticking when the top cover is moved to the open position.

* * * * *